US011384929B2

(12) United States Patent
Lupien

(10) Patent No.: US 11,384,929 B2
(45) Date of Patent: Jul. 12, 2022

(54) FIRE RATED RECESSED LIGHTING FIXTURE

(71) Applicant: De Brousse & Crémant Inc., Montreal (CA)

(72) Inventor: Pierre-Paul Lupien, Montreal (CA)

(73) Assignee: De Brousse & Crémant Inc., Montreal (CA)

( * ) Notice: Subject to any disclaimer, the term of this patent is extended or adjusted under 35 U.S.C. 154(b) by 0 days.

(21) Appl. No.: 17/375,362

(22) Filed: Jul. 14, 2021

(65) Prior Publication Data

US 2022/0082244 A1 Mar. 17, 2022

Related U.S. Application Data

(60) Provisional application No. 63/077,198, filed on Sep. 11, 2020.

(51) Int. Cl.

| | |
|---|---|
| ***F21V 25/12*** | (2006.01) |
| ***F21S 8/02*** | (2006.01) |
| *F21Y 115/10* | (2016.01) |

(52) U.S. Cl.
CPC ..... *F21V 25/12* (2013.01); *F21S 8/026* (2013.01); *F21Y 2115/10* (2016.08)

(58) Field of Classification Search
CPC ..... F21V 25/12; F21S 8/026
See application file for complete search history.

(56) References Cited

U.S. PATENT DOCUMENTS

| | | | | |
|---|---|---|---|---|
| 4,930,054 | A | 5/1990 | Krebs | |
| 5,222,800 | A | 6/1993 | Chan et al. | |
| 6,551,130 | B2 | 4/2003 | Bonilla | |
| 7,470,048 | B2 | 12/2008 | Wu | |
| 7,476,010 | B2 | 1/2009 | Johnson | |
| 7,651,248 | B2 | 1/2010 | Hua | |
| 9,797,563 | B2 | 10/2017 | Luo et al. | |
| 2009/0086474 | A1* | 4/2009 | Chou | F21K 9/90 362/230 |
| 2009/0135608 | A1* | 5/2009 | Sell | F21V 19/0055 362/365 |
| 2009/0147517 | A1* | 6/2009 | Li | F21V 29/75 362/249.02 |
| 2010/0024338 | A1 | 2/2010 | Cordts | |
| 2012/0127731 | A1* | 5/2012 | Masuda | F21V 17/06 362/341 |
| 2016/0061421 | A1* | 3/2016 | Winters | F21V 29/70 362/310 |
| 2016/0363297 | A1* | 12/2016 | Boulanger | F21V 17/14 |
| 2018/0266634 | A1* | 9/2018 | Dong | F21V 29/763 |

FOREIGN PATENT DOCUMENTS

| | | | |
|---|---|---|---|
| EP | 1 686 315 | A1 | 8/2006 |
| EP | 1 688 663 | A2 | 8/2006 |
| WO | WO 2005/124225 | A1 | 12/2005 |

* cited by examiner

*Primary Examiner* — Evan P Dzierzynski
(74) *Attorney, Agent, or Firm* — Agence de Brevets Fournier

(57) ABSTRACT

A recessed lighting fixture includes a one-piece casing having i) a flat-crown-hat-shaped to be secured to a ceiling or the like and that is made of a fire-retardant material, ii) a flange fitting that is removably mounted to the one-piece casing therein, and iii) a light-emitting diode (LED) assembly mounted to the flange fitting therein.

12 Claims, 2 Drawing Sheets

FIRE RATED RECESSED LIGHTING FIXTURE

CROSS REFERENCE TO RELATED PATENT APPLICATION

This application claims the benefit of U.S. Provisional Application No. 63/077,198, filed on Sep. 11, 2020, the content of which is incorporated by reference herein.

FIELD

The present disclosure generally relates to light fixtures. More specifically, the present disclosure relates to a fire rated recessed lighting fixture.

BACKGROUND

A recessed lighting fixture is a well-known type of light fixture that is configured to be installed into a hollow opening in a ceiling or in another similar opening. It conventionally includes three main parts: a housing, a trim and a bulb, the trim being the visible portion of the fixture, including a thin lining around the edge of the lighting fixture, and the housing being inside the ceiling and containing the bulb holder.

Building and housing regulations require that lighting fixtures be capable to prevent or at least to minimize the spread of fire.

An example of a fire-resistant lighting fixture is disclosed in international application publication No. WO 2005/124225 published on Nov. 29, 2005, titled "Heat Resistant Casing" and naming Rawlins as the inventor. Rawlins' fixture is configured for incandescent bulb, and as such aims at being both fire-resistant and at preventing overheating. For such reason, it includes several ventilation openings in the top portion of the housing and since such openings could allow the spread of a fire, if further includes in the housing a solid fire-resistant intumescent material positioned between the interior surface of the top of the housing and the electrical fitting, which is configured to expend during a fire to help prevent a fire from spreading.

In addition to being complicated as including many safety components and to being relatively costly to manufacture, such fire-retardant mechanism has two safety mechanisms that might work one against the other in some situations defeating their respective purpose.

European patent application No. 1 688 633 published on Aug. 9, 2006, naming Hua as the inventor and titled "Fire-resistant lighting fixture" describes another fire-resistant lighting fixture that includes, similarly to Rawling, ventilation holes and bodies of material, secured to the main housing, that aim at inhibiting the transmission of fire. This lighting fixture by Hua shares some drawback with Rawlins', including the fact that only parts of the main housing is configured to inhibit the transmission of fire.

SUMMARY

The problem of the limited capability of known recessed lighting fixtures to act as a fire-retardant, and their relative complexity for including many parts aiming to achieve the afore-mentioned function, is solve by providing a one-piece casing, to be secured to a ceiling or the like, that is made of a fire-retardant material and by mounting a light-emitting diode (LED) assembly to the flange fitting that is in turn mounted to the one-piece casing.

A person skilled in the art would appreciate that using a light-emitting diode (LED) assembly removes the need to provide ventilation holes in the casing which can contribute to accelerating a fire. It can further allows limiting the height of the casing, reducing the overall cost of the fixture.

According to illustrative embodiments, there is provided a recessed lighting fixture comprising:

a one-piece casing made of a fire-retardant material; the one-piece casing having a flat-crown-hat-shaped defined by a peripheral wall having first and second longitudinal edges, a top wall that closes the peripheral wall at the first longitudinal edge and a peripheral flange extending outwardly from the peripheral wall near the second longitudinal edge;

at least two spring clips that are operatively secured to the one-piece casing;

a flange fitting assembly that includes i) a ring portion having first and second longitudinal edges and being configured to be snugly mounted to the one-piece casing therein at the second longitudinal edge thereof, and ii) an outer flange portion that extends outwardly from the ring portion near the second longitudinal edge thereof and generally perpendicularly therefrom; and a light-emitting diode (LED) assembly operatively mounted to the flange fitting.

According to other illustrative embodiments, there is provided a recessed lighting fixture comprising a one-piece casing to be secured to a ceiling or the like that is made of a fire-retardant material, a flange fitting that is removably mounted to the one-piece casing therein, and a light-emitting diode (LED) assembly mounted to the flange fitting therein.

According to still other illustrative embodiments, there is provided a lighting to be mounted in a panel comprising: a single body cylindrical container made of a fire-proof material and having an opening that receives a flange fitting therein and a cold lighting assembly mounted to the flange fitting therein.

Other objects, advantages and features of the recessed lighting fixture will become more apparent upon reading the following non-restrictive description of preferred embodiments thereof, given by way of example only with reference to the accompanying drawings.

DETAILED DESCRIPTION

Figure 1:
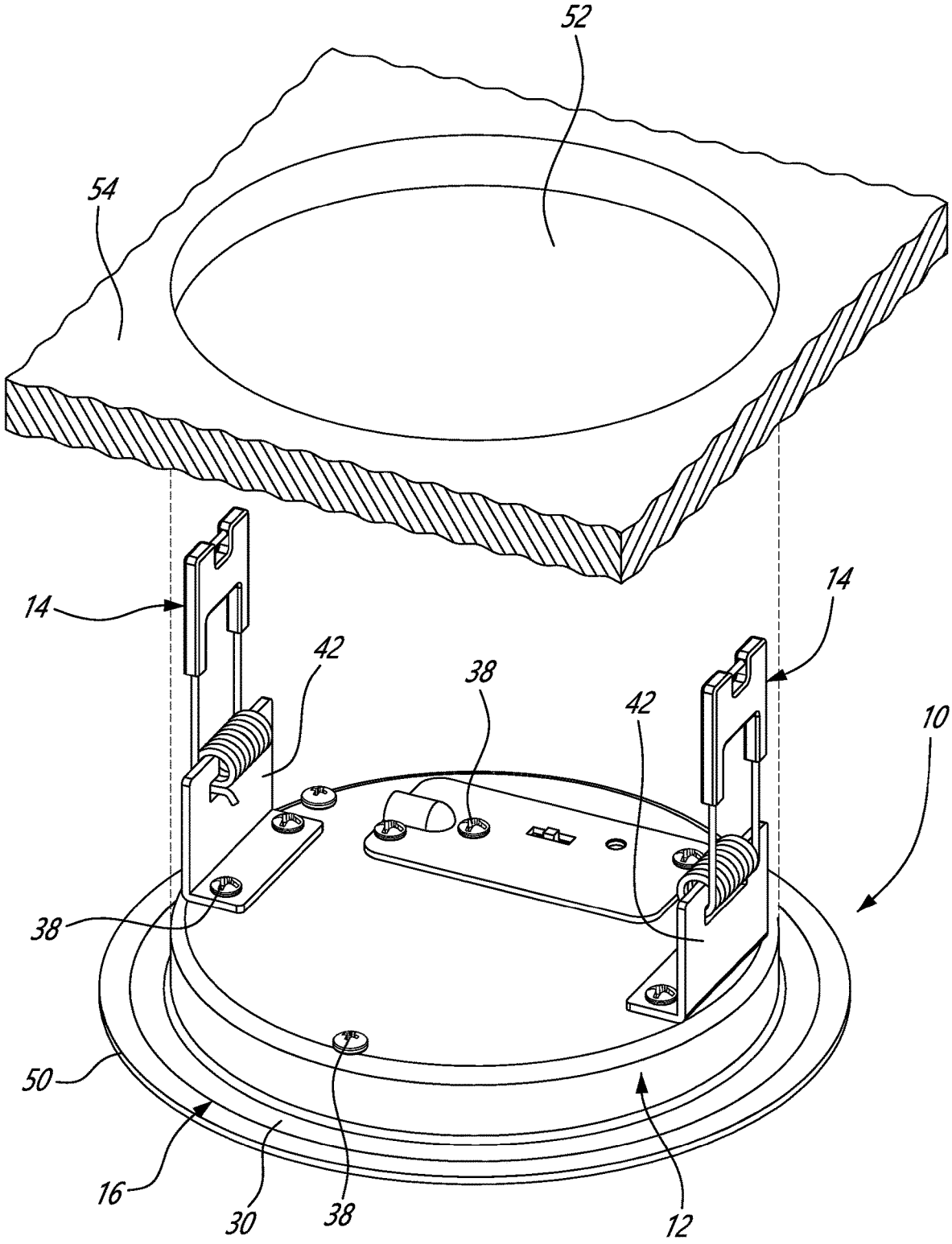
FIG. 1 is a perspective view of a recessed lighting fixture according to an illustrative embodiment; the recessed lighting fixture being shown ready to be installed into a hollow opening in a ceiling.

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

Figure 2:
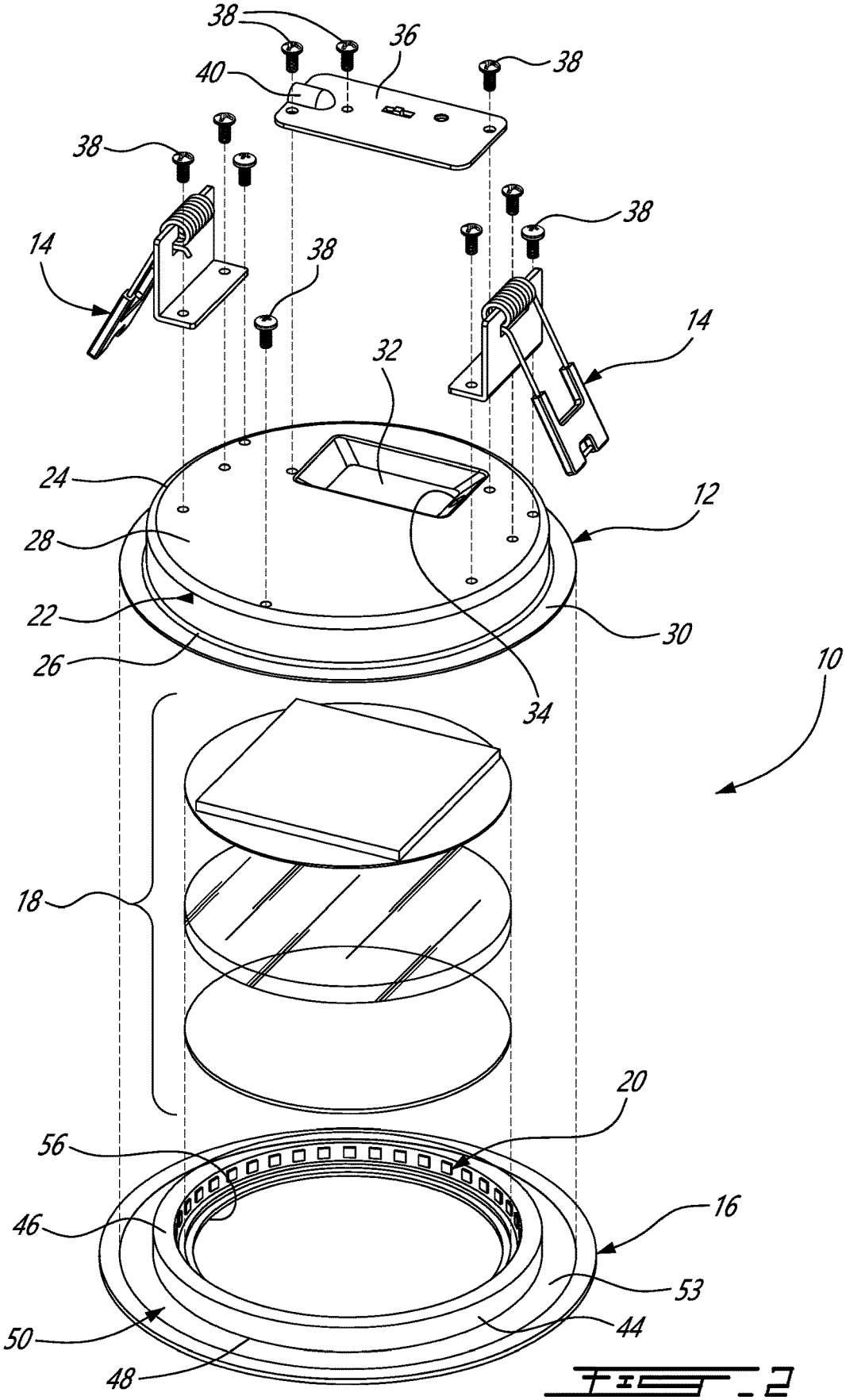
FIG. 2 is an exploded view of the recessed lighting fixture from FIG. 1.

A recessed lighting fixture 10 according to an illustrative embodiment will now be described with reference to FIGS. 1 and 2.

The recessed lighting fixture 10 comprises a one-piece casing 12, two spring clips 14 that are operatively secured to the one-piece casing 12, a flange fitting 16 that is configured to be snugly mounted to the one-piece casing 12 therein, a lenses assembly 18 secured to the flange fitting 16 therein, and a light-emitting diode (LED) assembly 20, in the form of a well-known flexible LED strip, secured to the flange fitting 16.

Each of these components of the recessed lighting fixture 10 will now be described in more detail.

The one-piece casing made 12 is made of a fire-retardant material such as cold rolled steel (SPCC). According to another embodiment (not shown), the casing 12 is a made of a plurality of pieces that are assembled using, for example, a laser welding process with a fire-resistant welding material, such as stainless steel. According to still another embodiment, the casing 12 is made of another fire-retardant material such as ceramic.

The one-piece casing 12 has a flat-crown-hat-shaped defined by a cylindrical wall 22 having first and second longitudinal tapered edges 24-26, a top wall 28 that closes the cylindrical wall 22 at the first longitudinal edge 24 thereof and a peripheral flange 30 extending outwardly from the cylindrical wall 22 near the second longitudinal edge 26, generally perpendicularly therefrom.

The cylindrical wall 22 is not limited to the illustrated embodiment and can have any shape allowing to integrally join the top wall 28 and the flange 30 while creating a distance therebetween.

The top wall 28 has an embossed portion 32 defining a lodging on the side thereof opposite the peripheral flange 30. The lodging 32 is provided to receive a well-known selector switch with PCB assembly (not shown), parts thereof or other electrical and/or electronic components. The lodging 32 is provided with a connector-receiving hole 34 therein to allow passage for connectors or any wirings (not shown) from the LED assembly 20.

The recessed lighting fixture 10 further comprises a cap 36 that is removably secured to the top wall 28 for closing the lodging 32. The cap 36 is removably secured to the top wall 28 via fasteners 38. Like the casing 12, the cap 36 is made of a fire-retardant material. The cap 36 includes an embossed portion 40, defining with the top wall 28 a channel to allow passage for electrical wirings (not shown). According to another embodiment (not shown), the cap 36 is mounted to the casing 12 differently than illustrated, such as slidably via tracks provided thereon.

According to another embodiment (not shown), the embossed portion 40 is replaced by a hole in the cap 36 or by a convex cap.

While the lodging 32 and cap 36 are illustrated as being rectangular, there are not limited to such configuration and can also be, without limitations, circular, irregular, etc. The overall dimensions of the lodging 32 may also differ than illustrated.

According to another embodiment (not shown), the lodging 32 is omitted.

The two spring clips 14 are operatively secured to the one-piece top wall 28 of the casing 12 at two diametrically opposite sides thereof via L-shaped mounting brackets 42, which are secured to the casing 12 via fasteners 38. According to another embodiment, the spring clips 14 are secured to the casing 12 using brackets or holders having another configuration. According to still another embodiment (not shown), the spring clips 14 are secured to another portion of the casing 12. Since spring clips are believed to be well-known in the art, they will not be described herein in more detail for concision purposes.

The flange fitting 16 includes i) a ring portion 44 having first and second longitudinal edges 46-48 and being configured to be snugly mounted to the one-piece casing 12 therein, through the second longitudinal edge 26 thereof.

The flange fitting 16 further includes an outer flange 50 that extends outwardly from the ring portion 44 near the second longitudinal edge 48 thereof and generally perpendicularly therefrom. The flange 50 acts as a trim to cover any gap between the cylindrical wall 22 of the casing 12 and the edge of the mounting hole 52 in the ceiling or wall 54 into which the recessed lighting fixture 10 is to be mounted. The flange 50 further acts as a mechanical stop when mounting the lighting 10 into the hole 52, and as a heat-sink.

The flange fitting 16 includes a recessed groove 53 between the ring portion 44 and the step/flange 50. The flange fitting 16 is designed to receive and secure the peripheral flange 30 of the casing 12. It also contributes to forming an airtight envelop and keeping the flame-retardant casing 12 secured in place. It further provides an aesthetic purpose to allow the surface of the plane 30 and 50 to sit flush against the fire rated ceiling surface.

The flange fitting 16 also includes an inner flange 56 that extends inwardly from the ring portion 44 near the second longitudinal edge 48 thereof and generally perpendicularly therefrom. The flange 56 defines with the ring portion 44 a housing for the lens's assembly 18.

It is to be noted that the lenses assembly 18 may include any number and variety of glass and/or polymeric pieces and is then not limited to the illustrated embodiment.

The flange fitting 16 is secured to the casing 12 therein using mounting fasteners 38.

According to another embodiment (not shown), the flange fitting 16 is secured to the casing 12 therein by press-fitting or by using another arrangement between the flange fitting 16 and casing 12.

The flange fitting 16 is made of any material, including without limitations aluminum, plastic, ceramic, steel, etc.

According to a further illustrative embodiment (not shown), the LED assembly is in the form of a solid PCB (printed circuit board) that is secured to one of the flange fitting 16 and casing 12. According to a more specific embodiment (not shown), a reflector is mounted between the LED assembly and the flange fitting 16. Such a reflector can be in the form, without limitations, of a frustoconical body mounted to flange fitting 16 underneath the solid PCB.

Since light-emitting diode (LED) assembly are believed to be well-known in the art, it will not be described herein in more detail for concision purposes.

It is to be noted that many modifications could be made to the recessed lighting fixture 10 described hereinabove and illustrated in the appended drawings. For example:

the LEDs assembly 20 can be mounted to a detachable part (not shown) independent from the flange fitting 16 so as to be mountable thereto. For example, such a detachable part can be in the form of a ring or clip that is mountable to a receiving part of the flange fitting.

LED assembly is not limited to being mounted to a PCB;

while the recessed lighting fixture 10 according to the illustrated embodiment has a general circular configuration, it can have another configuration, such as rectangular, square, irregular, etc.

while some parts of the fixture 10 are assembled using fasteners, other fastening means, such as male-female cooperating elements or press-fit or clipping parts can also be used.

Although a recessed lighting fixture has been described hereinabove by way of illustrated embodiments thereof, it can be modified. It is therefore to be understood that numerous modifications may be made to the illustrative embodiments. It is therefore to be understood that numerous modifications may be made to the illustrative embodiments and that the scope of the claims should not be limited by the illustrative embodiment but should be given the broadest interpretation consistent with the description as a whole.

What is claimed is:

1. A recessed lighting fixture comprising:

a one-piece casing made of a fire-retardant material; the one-piece casing including i) a peripheral wall having first and second longitudinal edges, ii) a top wall that closes the peripheral wall at the first longitudinal edge thereof and iii) a peripheral flange extending outwardly from the peripheral wall near the second longitudinal edge thereof;

at least two spring clips that are operatively secured to the one-piece casing;

a flange fitting assembly that includes i) a ring portion having first and second longitudinal edges and being configured to be snugly mounted to the one-piece casing therein at the second longitudinal edge of the peripheral wall thereof, and ii) an outer flange portion that extends outwardly from the ring portion near the second longitudinal edge thereof and generally perpendicularly therefrom; and a light-emitting diode (LED) assembly operatively mounted to one of the one-piece casing and flange fitting.

2. A recessed lighting fixture as recited in claim 1, wherein the one-piece casing having a flat-crown-hat-shaped.

3. A recessed lighting fixture as recited in claim 1, further comprising at least one lens secured to the flange fitting therein.

4. A recessed lighting fixture as recited in claim 3, wherein the flange fitting including an inner flange that extends inwardly from the ring portion near the second longitudinal edge thereof; the inner flange defining a housing for the at least one lens.

5. A recessed lighting fixture as recited in claim 1, wherein the top wall of the one-piece casing having an embossed portion defining a lodging on a side of the top wall opposite the peripheral flange.

6. A recessed lighting fixture as recited in claim 5, further comprising a cap made of a fire-retardant material that is removably secured to the top wall for closing the lodging.

7. A recessed lighting fixture as recited in claim 6, wherein the cap including an embossed portion which defines with the top wall a channel that allows passage for connectors.

8. A recessed lighting fixture as recited in claim 5, wherein the lodging is provided with a connector-receiving hole therein to allow passage for connectors from the LED assembly.

9. A recessed lighting fixture as recited in claim 1, further comprising a convex cap made of a fire-retardant material that is removably secured to the top wall for defining a lodging therewith.

10. A recessed lighting fixture as recited in claim 1, wherein the flange fitting including an annular groove between the ring portion and outer flange portion for complementary receiving the peripheral flange of the one-piece casing.

11. A recessed lighting fixture as recited in claim 1, wherein the LED assembly includes at least one of a flexible LED strip and a solid printed circuit board (PCB).

12. A recessed lighting fixture as recited in claim 1, wherein the fire-retardant material is cold rolled steel (SPCC) or a ceramic.

* * * * *